United States Patent [19]

Courson et al.

[11] 3,989,133

[45] Nov. 2, 1976

[54] TRANSPORTATION APPARATUS

[75] Inventors: Iber C. Courson; Joseph K. Kraft, both of Gettysburg, Pa.

[73] Assignee: Westinghouse Electric Corporation, Pittsburgh, Pa.

[22] Filed: Feb. 20, 1975

[21] Appl. No.: 551,560

[52] U.S. Cl. ..... 198/335; 292/256

[51] Int. Cl.[2] ..... B66B 9/12

[58] Field of Search ..... 198/16 R, 16 MS, 17, 198/18, 204; 104/25; 292/256, 256.67, 256.71

[56] References Cited

UNITED STATES PATENTS

| | | | |
|---|---|---|---|
| 1,533,725 | 4/1925 | Davenport | 292/256 |
| 3,321,059 | 5/1967 | Kroepel | 198/16 R |

*Primary Examiner*—Evon C. Blunk
*Assistant Examiner*—Joseph E. Valenza
*Attorney, Agent, or Firm*—D. R. Lackey

[57] ABSTRACT

Transportation apparatus for transporting persons between spaced landings, including a conveyor mounted on a support structure, and a balustrade formed of a plurality of panels aligned in end-to-end relation. An endless handrail is guided over the top edge of the balustrade via a handrail guide member which extends to and partially defines newel sections at opposite ends of the transportation apparatus. Support channels extend from newel to newel to support the lower edge of the balustrade. Structural members complete the newels, extending from the opposite ends of the support channel to the ends of the handrail guide member. The structural members are tapered to provide a stepless transition from the handrail guide members, which are relatively thin, to the larger dimension of the support channel. Support for the structural members, which are cantilevered outwardly from the support structure, is provided by a splice-clamp arrangement which provides excellent support and lateral stability.

8 Claims, 9 Drawing Figures

10
12
13
14
16
22
24
26
27
28
29
32
36
38
50
52
54
56
57
59
61
63
70
72
74
76
78
80
82
84
86
88
90
94
142
150
160
162
III
VI

FIG.2
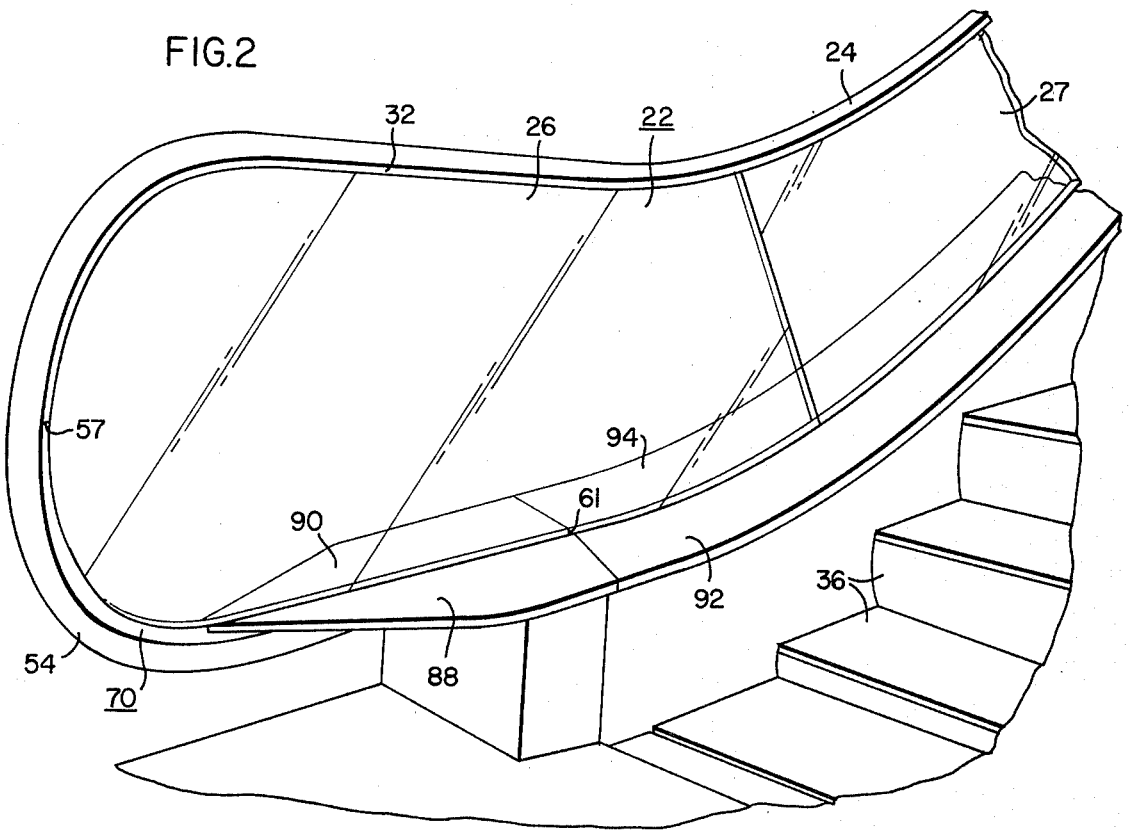
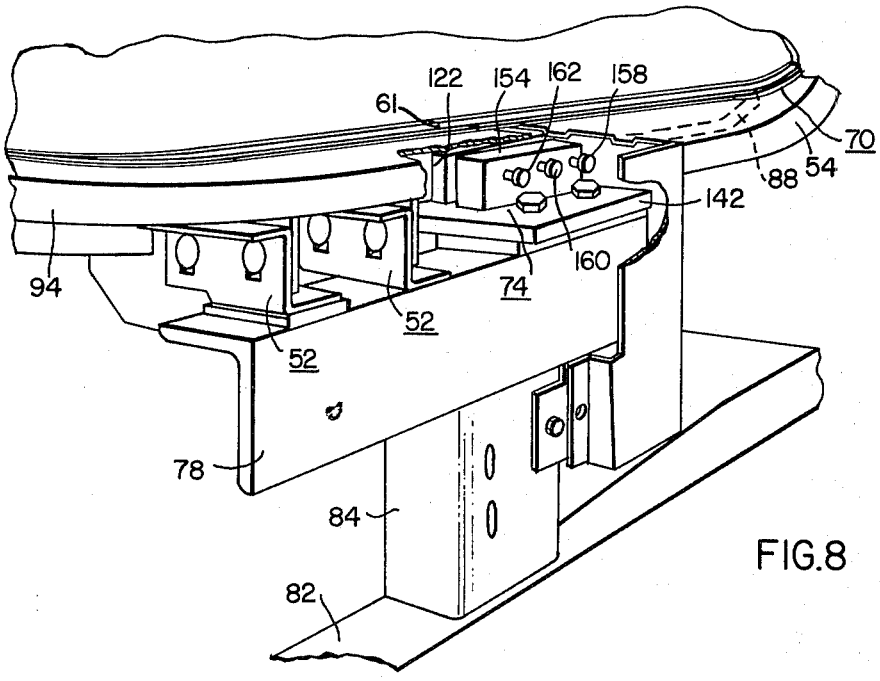
FIG.8

24
32
22
27
52
50
128
57
124
126
132
130
112
133
70
102
122
V
114
116
61
120
118
106
110
104
108
100

TRANSPORTATION APPARATUS

BACKGROUND OF THE INVENTION

1. Field of the Invention

The invention relates to transportation apparatus for moving people between spaced landings, such as moving stairways and walks.

2. Description of the Prior Art

Transportation apparatus for moving people from one landing to another, of the type which includes a belt, or a plurality of steps, platforms or pallets, such as moving stairways and walks, often utilize a plurality of transparent panel members aligned in end-to-end relation to provide a balustrade. U.S. Pat. Nos. 3,170,557; 3,283,878; 3,321,059; 3,353,650 and 3,653,484 illustrate transportation apparatus of this type.

The transparent panels provide a spacious, inviting, unencumbered appearance, and it is desirable to add to this effect by eliminating as much visible structure as possible. Certain prior art apparatus with transparent balustrades utilize balustrade posts disposed between the adjoining ends of transparent balustrade panels, in order to provide support for the panels as well as for a handrail guide assembly mounted on the top edge of each balustrade. In order to reduce the amount of visible structure, certain prior art transportation apparatus eliminates the balustrade posts and utilizes a mechanical clamping arrangement having movable parts for mounting the handrail guide assembly on the upper edge of the balustrade.

The lack of structure in the balustrade has been extended still further by copending application Ser. No. 551,558, filed Feb. 20, 1975, assigned to the same assignee as the present application, which discloses a handrail guide assembly which mounts on the upper edge of the balustrade without requiring movable parts. The handrail guide assembly disclosed in this copending application allows the vertical centerlines of the glass panels of the balustrade, the handrail guide assembly, and the handrail to be aligned. The structure of this handrail guide assembly is so compact that it is barely visible below the handrail, and since the vertical centerlines of the handrail and glass panels are aligned, it provides the pleasing effect of the handrail traveling over the edge of the balustrade without apparent guide or support.

Copending application Ser. No. 551,559, filed Feb. 20, 1975, which is assigned to the same assignee as the present application, provides a new and improved arrangement for supporting transparent balustrades on the truss of the transportation apparatus. This new and improved mounting arrangement utilizes a support channel in which the lower edges of the balustrade panels are disposed. The support channel functions as a clamp which securely clamps the balustrade panels in the desired vertical orientation, with a plurality of spaced clamp assemblies fastened to the truss simultaneously bending the support channel to clamp the panels of the balustrade, and clamping the support channel to the truss.

Transportation apparatus of the type which utilizes transparent balustrades terminates at each end in curved newel sections, which are cantilevered outwardly from the supporting truss. It would be desirable to provide new and improved newel sections which utilize the handrail guide arrangement of copending application Ser. No. 551,558, and the panel support arrangement of copending application Ser. No. 551,559, which properly coordinates these arrangements in the newel sections while providing the essential support and lateral stability for the cantilevered newel sections.

SUMMARY OF THE INVENTION

Briefly, the present invention is new and improved transportation apparatus having a balustrade formed of a plurality of panels aligned in end-to-end relation, which may be transparent. An endless handrail is guided over the upper edge of each balustrade by a guide assembly, such as disclosed in the herebeforementioned copending application Ser. No. 551,558, which mounts directly on the balustrade without the necessity of providing balustrade posts. The guide assembly has no movable parts, it centers the handrail over the balustrade, and exposes very little of its support and guide structure below the handrail. The panels of the balustrade are supported in support channels which are bent by a plurality of spaced clamps to clamp and orient the panels in the channels, such as disclosed in the herebeforementioned copending application Ser. No. 551,559.

The handrail guide assembly extends to and partially defines each newel section. The difference in the depth of the recess in the handrail guide assembly, which receives the upper edge of the balustrade, and the depth of the recess in the support channel, which receives the lower end of the balustrade and necessarily extends inwardly on the balustrade panels for a greater distance than the handrail guide assembly, in order to properly clamp and vertically orient the panels, is accommodated by a single structural member. The single structural member extends between an end of the support channel to an end of the handrail guide assembly to cooperate with the handrail guide assembly in defining a newel section. The depth of the recess in the structural member is smoothly tapered to provide a stepless transition between the handrail guide assembly and the support channel, with the tapered member being spliced to the handrail guide assembly and to support channel. The splice between the structural member and the support channel is supported in a newel clamp assembly which is actuated to apply pressure to the splice, and to the opposite side of the support channel, which provides the required support and lateral stability for the cantilevered newel section.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 1 is a view in side elevation of transportation apparatus constructed in accordance with the teachings of the invention, which illustrates the construction of the balustrade, the handrail guide assembly, and the balustrade support;

FIG. 2 is a fragmentary perspective view of the transportation apparatus shown in FIG. 1, illustrating the lower newel section of the apparatus;

FIGS. 8 and 9 are perspective views of the newel clamp assembly shown in FIGS. 1, 6 and 7, illustrating the newel clamp assembly in assembled relation with the transportation apparatus.

DESCRIPTION OF PREFERRED EMBODIMENTS

Figures 1, 9:
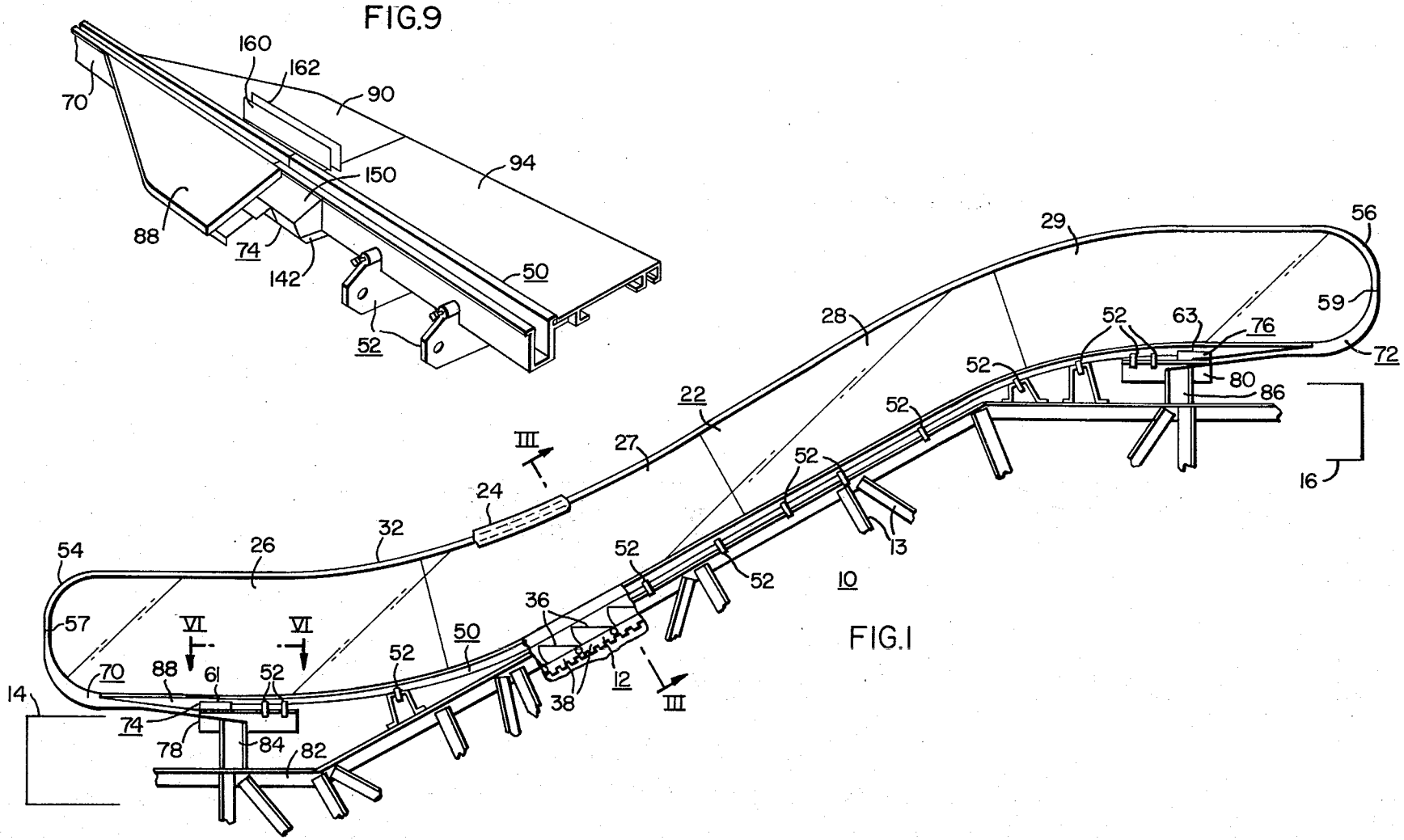

Referring now to the drawings, and FIG. 1 and 2 in particular, there is shown transportation apparatus 10 of the type which may utilize the teachings of the invention. Transportation apparatus 10 employs a conveyor 12 for transporting passengers between a first landing 14 and a second landing 16. Conveyor 12 is preferably of the endless type conventionally used in moving walks and moving stairways. If the conveyor 12 is a moving walk, it may have a belt-type treadway, or a pallet-type. For purposes of example, it will be assumed that the conveyor 12 is in the form of a moving stairway, such as described in detail in U.S. Pat. Nos. 3,667,388; 3,682,289, and 3,707,220, which are assigned to the same assignee as the present application.

Conveyor 12, which is supported by a support structure or truss, shown generally at 13, includes an upper load bearing run on which passengers stand, and a lower return run. A balustrade 22 is disposed above the conveyor 12 for guiding a continuous, flexible handrail 24. The balustrade 22 guides the handrail 24 about the upper run of a closed handrail loop, which also includes a lower run. A balustrade similar to balustrade 22 is spaced from balustrade 22 to provide two spaced handrails which may be grasped by passengers, but since the additonal balustrade is similar to balustrade 22, only one balustrade is illustrated.

Balustrade 22 is formed of a plurality of vertically oriented panel members 26, 27, 28 and 29 aligned in end-to-end relation to define substantially continuous upper and lower edge portions. The panel members are preferably transparent, such as tempered glass, having a thickness dimension of about 0.5 inch (12.7 mm), and the invention will be described assuming that the panel members are formed of glass. However, it is to be understood that the panel members may be formed of any other suitable material such as metallic or plastic panel members.

Handrail 24 is preferably guided over the upper edge of the balustrade 22 by new and improved guide means 32 which is disclosed and described in the hereinbefore mentioned copending application Ser. No. 551,558. Handrail guide means 34 extends to and partially defines lower and upper newel sections 54 and 56, respectively, terminating at points 57 and 59, respectively.

Conveyor 12 includes a plurality of steps 36, only a few of which are illustrated in FIG. 1. The steps 36 move in a closed path, with the conveyor 12 being driven in a conventional manner, such as illustrated in U.S. Pat. No. 3,414,109, or the conveyor may be driven by a modular drive arrangement, as disclosed in the herebefore mentioned U.S. Pat. Nos. 3,677,388; 3,682,289 and 3,707,220. As disclosed in these three patents, the conveyor 12 includes an endless belt formed of toothed links 38 to which the steps 36 are connected. The endless belt and steps 36 are driven by a modular drive unit (not shown) which includes sprocket wheels and a drive chain for engaging the toothed links 38.

The balustrade 22 is preferably mounted on the support structure or truss 13 with new and improved mounting means which includes elongated support channels 50, with the new and improved mounting means being disclosed and described in the hereinbefore mentioned copending application Ser. No. 551,559. The lower edges of the panel members of the balustrade 22 are disposed in the recess of the support channels 50. The support channels 50 terminate at points 61 and 63, adjacent the start of the lower and upper newel sections 54 and 56, respectively. This new support arrangement also includes a plurality of clamp assemblies 52 which are fastened to truss 13 in spaced relation, which lock the support channels 50 to the truss 13 and simultaneously bend the support channels to clamp and vertically align the panel members of the balustrade 22.

Figures 3, 4, 5:
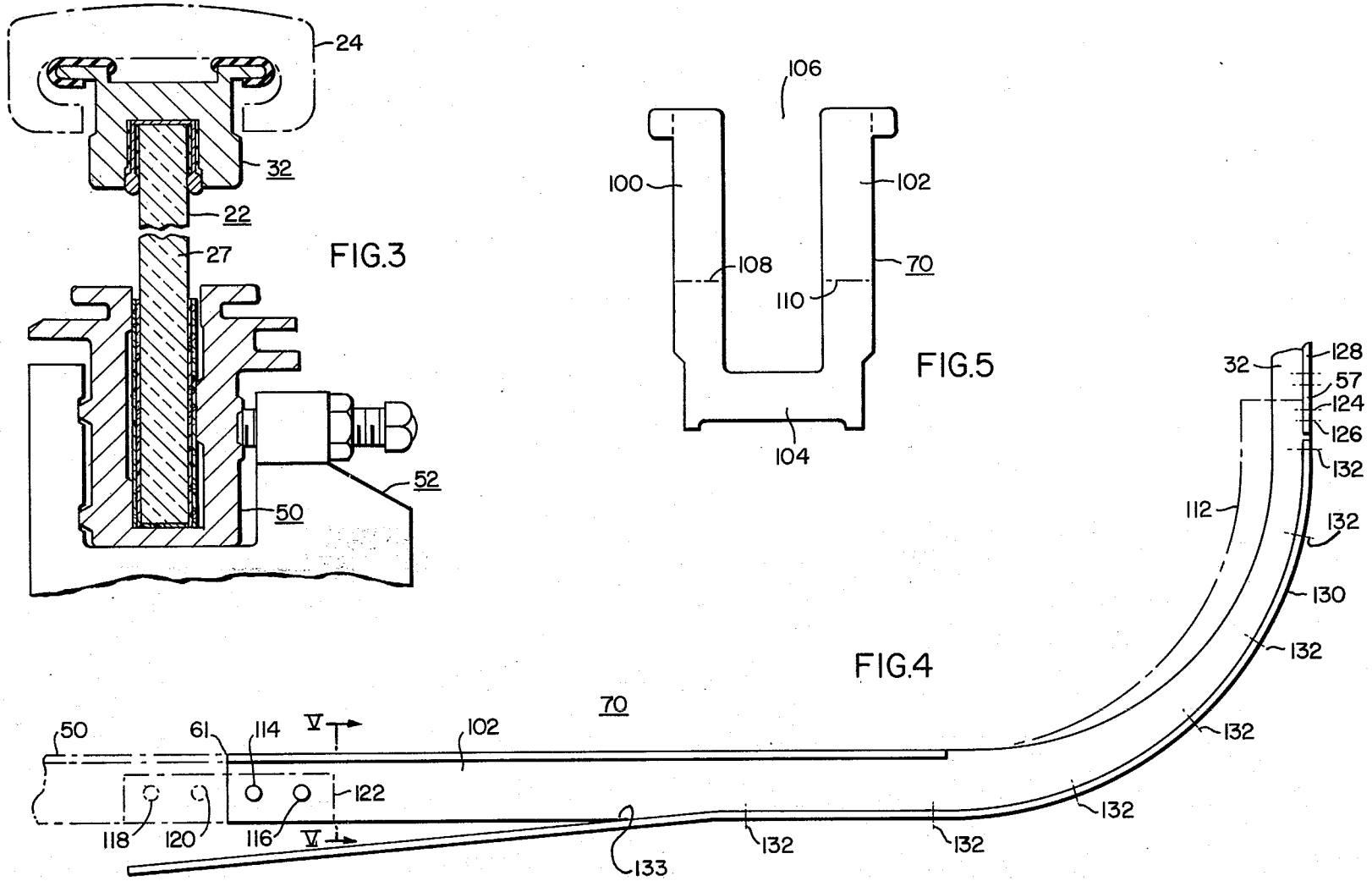
FIG. 3 is a cross-sectional view of the transportation apparatus shown in FIG. 1, taken in the direction of arrows III—III, which illustrates the handrail guide assembly and balustrade support channel, and the different depths of their recesses for receiving the edges of the balustrade.
FIG. 4 is an enlarged view of a structural member shown in FIG. 1, which has a tapered recess depth for providing a smooth transition between the handrail guide assembly and halustrate support channel.
FIG. 5 is a cross-sectional view of the structural member shown in FIG. 4, taken in the direction of arrows V—V.

FIG. 3 is a cross-sectional view of the transportation apparatus 10 shown in FIG. 1, taken generally between arrows III—III. FIG. 3 illustrates the very narrow profile of the handrail guide means 32 and the shallow U-shaped recess for receiving the upper edge of the balustrate 22, compared with the relatively deep recess in the support channel 50.

Returning to FIGS. 1 and 2, first and second structural members 70 and 72, constructed according to the teachings of the invention, are located adjacent the lower and upper newel sections 54 and 56, respectively. Structural members 70 and 72 provide a smooth, stepless transition between the ends of the support channel 50 and the ends of the handrail guide means 34, with structural member 70 extending between points 61 and 57, and structural member 72 extending between points 63 and 59. Structural members 70 and 72 cooperate with the handrail guide means 32 in defining the lower and upper newel sections 54 and 56, respectively.

Lower and upper newel clamping assemblies 74 and 76 cooperate with the structural members 70 and 72, respectively, to provide the necessary support and lateral stability for the cantilevered newel sections. Clamping assemblies 74 and 76 are mounted on truss members 78 and 80, respectively, which are mounted on the main truss chord 82 via vertically oriented truss members 84 and 86, respectively.

Tapered inner and outer deck panels 88 and 90 are connected to structural member 70 to complete the main inner and outer decks 92 and 94, respectively, at the lower newel 54, and similar tapered inner and outer deck panels are connected to structural member 72 to complete the main inner and outer decks 92 and 94 at the upper newel 56.

FIG. 4 is an elevational view of the lower newel structural member 70, viewing the structural member 70 from the side of the outer deck 94. Since structural members 70 and 72 are similar, only structural member 70 is described in detail.

Structural member 70 is constructed of a metallic member, such as an aluminum extrusion, which has a cross-sectional configuration which substantially matches that of the cross-sectional configuration of the support channel 50. FIG. 5 is a cross-sectional view of the structural member 70, taken in the direction of arrows V—V, with this cross-sectional view being enlarged to the scale of FIG. 3 in order to illustrate a configuration which may be used. As illustrated in FIG. 5, structural member 70 includes first and second spaced leg portions 100 and 102 joined by a bight 104, which cooperate to define a substantially U-shaped recess 106 which matches the recess provided in the support channel 50. Structural member 70 is tapered, while the structural member 70 is still in its straight configuration, such as by milling, to gradually reduce the depth of the recess 106. The tapering starts at a location which will form a curved portion of newel 54 and continues until reaching the end of the section which will mate with the handrail guide member 32 at point 57. The leg portions 100 and 102 are reduced in length by the tapering operation of the structural member 70, with the cross-sectional configuration of the structural member 70 at point 57 being indicated at FIG. 5 by the broken lines 108 and 110, which illustrate the ends of leg portions 100 and 102, respectively. After the tapering operation, the tapered portion of the structural member 70 is curved to the desired shape of the newel. The original configuration of structural member 70, before tapering, is illustrated in FIG. 4 with broken line 112.

Leg 102 is drilled and tapped adjacent point 61 to provide tapped openings 114 and 116, and the corresponding leg of channel member 50 is drilled and tapped to provide openings 118 and 120. A splice member 122 is disposed adjacent leg portion 102 of the structural member 70 such that it also overlaps the adjacent leg of channel member 50. Screws are inserted through openings in the splice member 122 into the tapped openings, to splice the support channel 50 to the structural member 70. The bight 104 of the structural member 70 is drilled and tapped at spaced locations indicated at 124 and 126 to receive a splice member 128 which is also fastened to the adjoining end of the handrail guide member 32. Splice member 128 continues the handrail guide portion of the handrail guide member 32, and an appropriately shaped member 130 is fastened to the bight 104 of structural member 70, such as by screws at the spaced locations 132, which continues the handrail guide configuration around the curved portion of the structural member 70. Member 130 departs from the bight 104 before reaching the end of the structural member 70, as indicated at point 133, in order to initiate the return run of the handrail 24. Splice member 122 is firmly fastened to the adjoining ends of the support channel 50 and the structural member 70 via screws 123, 125, 127 and 129, which extend through openings in the splice member 122 into the tapped openings 118, 120, 114 and 116, respectively.

Figure 6:
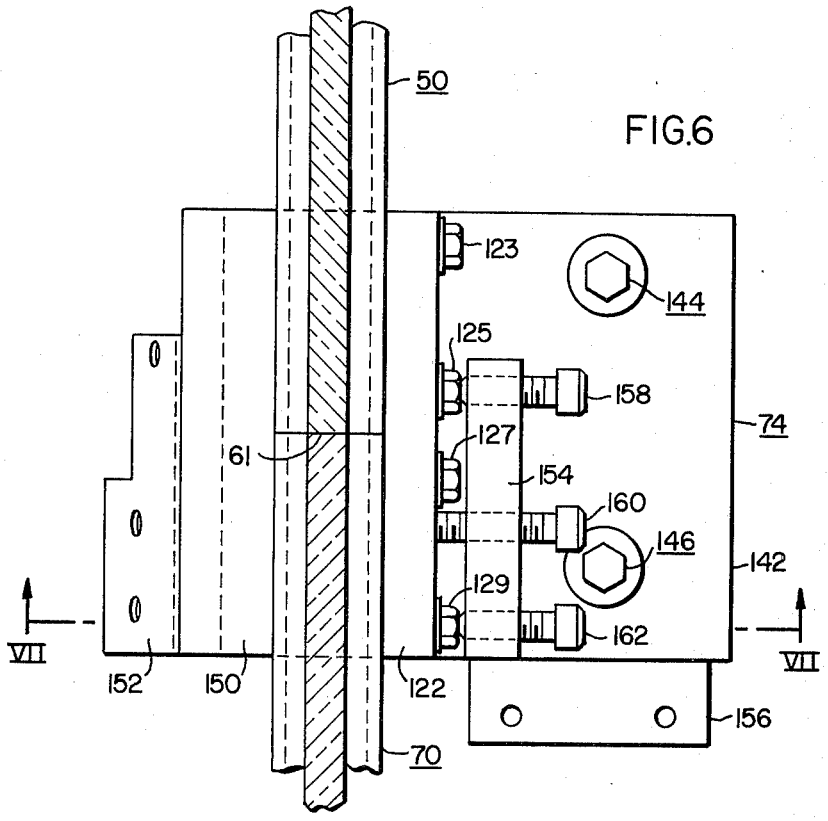
FIG. 6 is a plan view of a newel clamp assembly shown in FIG. 1, taken in the direction of arrows VI—VI, with the newel clamp being constructed according to the teachings of the invention.
Figure 7:
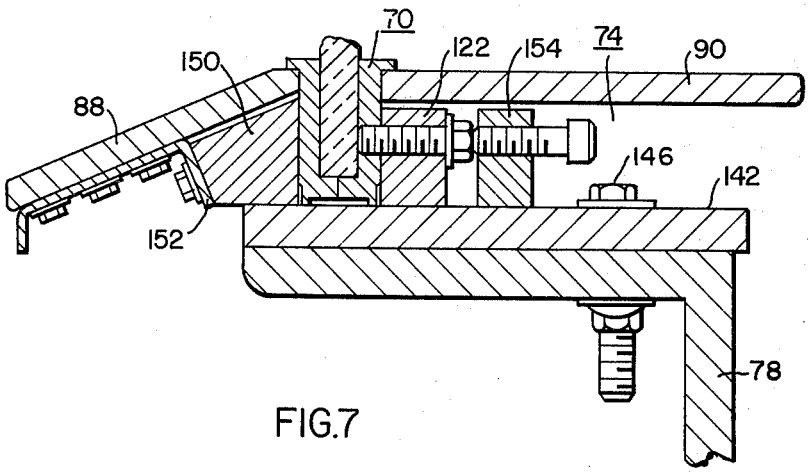
FIG. 7 is a cross-sectional view of the newel clamp assembly shown in FIG. 6, taken in the direction of arrows VII—VII.

Splice 122 is insufficient by itself to provide the necessary support and lateral stability required for the newel section 54, but the splice member 122 is combination with newel clamp 74 provides excellent support for the cantilevered newel, as well as excellent lateral stability. FIG. 6 is a plan view of the newel clamp assembly 74 shown in FIG. 1, taken generally in the direction of arrows VI—VI, and FIG. 7 is a cross-sectional view of newel clamp assembly 74, taken in the direction of arrows VII—VII, shown in FIG. 6. It will also be helpful to refer to the perspective views of the newel clamp 74 shown in FIGS. 8 and 9, with FIG. 8 being a perspective view of the newel clamp 74 as it appears from the outer deck side of the newel, and with FIG. 9 illustrating the newel clamp 74 as it appears from the inner deck side of the newel section.

Newel clamp 74 includes a base member 142 which is mounted to truss member 78 via nut and bolt assemblies 144 and 146. The adjoining ends of the support channel 50 and structural member 70, as well as the splice 122, rest upon this base member 142. A first clamp member 150 is fixed to the base member 142, such as by welding. The first clamp member 150 has a vertical surface disposed against the leg portions of the support channel 50 and structural member 70 which are on the side of the inner deck 88. The inner deck 88 may be fastened to the clamp member 50, such as via a bracket 152 illustrated in FIGS. 6 and 7.

A second clamp member 154 is spaced from the first clamp member 150 and is fixed to the base member 142, such as by welding, on the side of the support channel 50 and structural member 70 on which the outer deck 90 is located. The outer deck 90 may be fastened to the base member 142 of the newel clamp assembly 74, such as via a bracket 156 illustrated in FIG. 6.

The second clamp member 154 includes a plurality of clamp screws 158, 160 and 162 which are threadably engaged with the second clamp member via suitable tapped openings therein oriented to enable the clamp screws to contact the splice member 122 when the clamp screws are advanced. The clamp screws are located to strike the splice member 122 above its midpoint, and as illustrated, one or more of the clamp screws may be located to strike a head of a screw used to fasten the splice member 122 to the legs of the support channele 50 and structural member 70. The newel clamp 74 is symmetrically located below the point 61 at which the support channel 50 abuts the structural member 70, and the clamp screws 158, 160 and 162 are advanced to contact the splice member 122 and to firmly press the splice member 122 and the adjoining ends of the support channel 50 and structural member 70 firmly against the first clamp member 150.

Newel clamp assembly 74 is firmly and securely mounted on the truss member 78, and it firmly clamps the adjoining ends of the support channel 50 and structural member 70, as well as the splice member 122, to the truss 13. This clamping action of the structural member 70 to the truss 78 at the start of the cantilevered newel section provides the necessary resistance against twist of the structural member due to a lateral force being applied to the newel section, and it provides the necessary support for the cantilevered newel section. As illustrated in FIG. 9, sheets 160 and 162 of an elastomeric material, such as a cloth impregnated with plastic, are disposed within the recess of the channel member 50 at the newel clamp, between the balustrade panel and the sides of the recess in the support channel, in order to distribute the stresses applied to the panel by the newel clamp 74.

We claim as our invention:

1. Transportation apparatus for transporting persons between spaced landings, comprising:

a support structure, a load bearing conveyor mounted on said support structure, a balustrade, means mounting said balustrade on said support structure, said balustrade including a plurality of vertically oriented panel members aligned in abutting end-to-end relation to define substantially continuous upper and lower edge portions which terminate in first and second newel sections, a handrail, handrail guide means for said handrail, said handrail guide means including a guide member supported by said upper edge portion which extends to and partially defines said first and second newel sections, said guide member extending inwardly from said upper edge portion for a predetermined first dimension, said means mounting the balustrade on said support structure including a support channel and first and second structural members, said support channel extending inwardly from said lower edge portion for a predetermined second dimension which is greater than said first dimension, said first and second structural members each having first and second ends, and a substantially U-shaped recess which extends between said first and second ends, each of said first and second structural members having a straight portion adjacent its first end, and a curved portion adjacent its second end, said first and second structural members being disposed with their first ends substantially abutting opposite ends of said support channel and their second ends substantially abutting opposite ends of said guide member with their curved portions cooperating with said guide member in defining said first and second newel sections, the U-shaped recess adjacent the first end of each of said first and second structural members extending inwardly to a depth equal to said second dimension, with the depth of the recess being gradually reduced in the curved portion such that the depth of the recess is equal to said first dimension at the second end, to provide stepless transitional support for said panel members at each of said first and second newel sections between said guide member and said support channel, with the panel members which start at the first and second newel sections extending beyond the abutting ends of the associated structural member and support channel, and first and second clamping means on said support structure which connect the first ends of said first and second structural members, respectively, to said support channel, and allow the second ends of the first and second structural members to be cantilevered outwardly from said support structure while providing lateral stability in said first and second newel sections.

2. The transportation apparatus of claim 1 wherein each of the first and second clamping means includes a splice member fastened to the adjacent ends of the structural member and support channel, and a clamp assembly which clamps the splice member and the adjoining ends of the structural member and support channel firmly between spaced members of the clamp assembly to provide lateral support for the newel sections.

3. The transportation apparatus of claim 2 wherein the splice member is connected between an end of the support channel and the first end of one of the first and second structural members, and the clamp assembly is disposed to apply pressure to the splice member.

4. The transportation apparatus of claim 1 wherein the panel members are transparent.

5. The transportation apparatus of claim 1 wherein the panel members are glass.

6. The transportation apparatus of claim 1 wherein each of the first and second clamping means includes a splice member connected between an end of the support channel and the first end of one of the first and second structural members, with said splice member being connected to one of the sides of the support channel which defines the second dimension, and a clamp assembly for supporting and clamping the adjacent ends of the support channel and one of the structural members, with said clamp assembly also clamping said splice member.

7. The transportation apparatus of claim 6 wherein the clamp assembly includes a plurality of screws which provide the clamp pressure.

8. The transportation apparatus of claim 6 including pressure distributing means disposed between the sides of the balustrade and the sides of the support channel, at each of the first and second clamping means.

* * * * *